US006381912B1

(12) United States Patent
Sorkin

(10) Patent No.: US 6,381,912 B1
(45) Date of Patent: May 7, 2002

(54) APPARATUS AND METHOD FOR SEALING AN INTERMEDIATE ANCHOR OF A POST-TENSION ANCHOR SYSTEM

(76) Inventor: Felix L. Sorkin, 13022 Trinity Dr., P.O. Box 1503, Stafford, TX (US) 77497

( * ) Notice: Subject to any disclaimer, the term of this patent is extended or adjusted under 35 U.S.C. 154(b) by 0 days.

(21) Appl. No.: 09/750,753

(22) Filed: Dec. 29, 2000

(51) Int. Cl.[7] ..... E04C 5/08

(52) U.S. Cl. ..... 52/223.13; 52/223.1; 52/223.14; 24/459; 29/452

(58) Field of Search ..... 52/223.6, 223.13, 52/223.16; 24/122.6, 459, 464

(56) References Cited

U.S. PATENT DOCUMENTS 3,843,288 A * 10/1974 Howlett
4,037,979 A * 7/1977 Fastenau
4,799,307 A * 1/1989 Reigstad
5,072,558 A * 12/1991 Sorkin
5,271,199 A * 12/1993 Northern
5,630,301 A * 5/1997 Sieg
5,749,185 A * 5/1998 Sorkin
5,755,065 A * 5/1998 Sorkin
5,839,235 A * 11/1998 Sorkin
5,897,102 A * 4/1999 Sorkin
6,017,165 A * 1/2000 Sorkin
6,023,894 A * 2/2000 Sorkin
6,027,278 A * 2/2000 Sorkin
6,098,356 A * 8/2000 Sorkin
6,151,850 A * 11/2000 Sorkin
6,176,051 B1 * 1/2001 Sorkin
6,234,709 B1 * 5/2001 Sorkin

* cited by examiner

*Primary Examiner*—Beth A. Stephan
*Assistant Examiner*—Kevin McDermott
(74) *Attorney, Agent, or Firm*—Harrison & Egbert

(57) ABSTRACT

An intermediate anchorage system including an anchor member with an interior passageway, a tendon extending through the interior passageway of the anchor member, an elastomeric seal having one end affixed to the anchor member and extending outwardly therefrom, and a rigid ring member detachably received within an opposite end of the seal. The ring member has an inner diameter greater than an outer diameter of the tendon. The opposite end of the seal is in liquid-tight compressive contact with the exterior surface of the tendon when the ring member is detached from the seal. The interior passageway of the anchor, the seal and the ring member have an inner diameter, when joined together, which is larger than the outer diameter of the tendon so as to allow the anchor member, the seal and the ring member to slide along the length of the tendon.

17 Claims, 3 Drawing Sheets

APPARATUS AND METHOD FOR SEALING AN INTERMEDIATE ANCHOR OF A POST-TENSION ANCHOR SYSTEM

BACKGROUND OF THE INVENTION

1. Field of the Invention

The present invention relates to post-tensioning systems. More particularly, the present invention relates to post-tensioning systems having intermediate anchorages. Furthermore, the present invention relates to sealing devices for preventing liquid intrusion into the exposed sections of tendon in the post-tension system.

2. Description of Related Art

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them.

When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

There are many post-tension systems employing intermediate anchorages where the length of the slab is too long to tension with a single anchor. In these systems, the intermediate anchor is interposed between a live end and a dead end anchor. In the construction of such intermediate anchorage systems, the tendon extends for a desired length to the intermediate anchor. A portion of the sheathing is removed in the vicinity of the intermediate anchor. The intermediate anchor is installed onto a form board in accordance with conventional practice. The unsheathed portion of the tendon is received by a tensioning apparatus such that the tendon is stressed in the area between the dead end anchor and the intermediate anchor. After stressing the tendon, concrete is poured over the exterior of the sheathed tendon and over the dead end anchor and intermediate anchor. The remaining portion of the tendon extends from the intermediate anchor to either another intermediate anchorage or to the live end anchor. Intermediate anchorage systems are employed whenever the slab is so long that a single live anchor extending to a single dead end anchor is inadequate. For example, two intermediate anchorages would be used for slabs having a length of approximately 300 feet.

A problem that affects many of the intermediate anchorage systems is the inability to effectively prevent liquid intrusion into the unsheathed portion of the tendon. Normally, the unsheathed portion will extend outwardly, for a distance, from the intermediate anchor in the direction toward the dead end anchor. Additionally, another unsheathed portion will extend outwardly at the intermediate anchor toward the live end anchor. In normal practice with a single live anchor and without intermediate anchors, a liquid-tight tubular member is placed onto an end of the anchor so as to cover the unsheathed portion of the tendon. This is relatively easy to accomplish since the length of the tendon is minimal at the live end. However, it is a considerable burden to attempt to slide such a tubular member along the entire length of the tendon so as to form the liquid-tight seal at the intermediate anchorage. In normal practice, tape, or other corrosion protection materials, are applied to the exposed portion of the tendon adjacent the intermediate anchorage. Extensive practice with this technique has shown that it is generally ineffective for preventing liquid intrusion into the interior of the tendon or into the interior of the intermediate anchorage. As such, a great need has developed in which to protect the exposed areas of the tendon adjacent the intermediate anchorage.

It is an object of the present invention to provide an intermediate anchorage for a post-tension system which facilitates an effective seal over the exposed portion of the tendon at the intermediate anchorage.

It is another object of the present invention to provide a sealing mechanism for attachment to the intermediate anchorage and a post-tension system which prevents liquid intrusion.

It is a further object of the present invention to provide a sealing apparatus which facilitates the ability to slide the intermediate anchorage over a length of the tendon.

It is a further object of the present invention to provide a sealing apparatus which is easy to install and easy to use.

It is still a further object of the present invention to provide a sealing apparatus which is easy to manufacture and relatively inexpensive.

These and other objects and advantages of the present invention will become apparent from a reading of the attached specification and appended claims.

BRIEF SUMMARY OF THE INVENTION

The present invention is an intermediate anchorage comprising an anchor member having an interior passageway, a tendon extending through the interior passageway of the anchor member, an elastomeric seal having one end affixed to the anchor member and extending outwardly therefrom, and a rigid ring member detachably received within the opposite end of the seal. The ring member has an inner diameter greater than the outer diameter of the tendon. When the ring member is combined with the elastomeric seal and the anchor member, the anchor member and the elastomeric seal can easily slide along the length of the tendon to a desired position. The ring member, when removed from the seal, causes the seal to compress upon the tendon in liquid-tight sealing relationship.

The anchor member has a tubular extension extending outwardly therefrom. The seal is affixed to an exterior surface of the tubular extension. The tubular extension has an inner diameter greater than a diameter of the tendon. In the preferred embodiment of the present invention, the tubular extension has a slot formed therein. The seal has a protrusion extending inwardly therefrom so as to engage the slot of the tubular extension. The opposite end of the seal has an elasticity such that the opposite end of the seal has a diameter matching the outer diameter of the tendon when the ring member is detached from the seal.

The tendon has a sheathed portion and an unsheathed portion. The seal will be in compressive liquid-tight contact with the sheathed portion of the tendon when the ring member is detached therefrom. The unsheathed portion of the tendon is fixedly received within the interior passageway of the anchor member. The seal extends over and around the unsheathed portion of the tendon.

In the present invention, the ring member has a body portion with a shoulder extending radially outwardly therefrom at an end of the ring member opposite the seal. The shoulder facilitates the ability to manually remove the ring member from the end of the seal. The body has a tapered end opposite the shoulder. The seal is received around this tapered end.

The present invention is also a method for forming an intermediate anchorage in a post-tension system comprising the steps of: (1) forming an intermediate anchor member having an interior passageway; (2) affixing an elastomeric seal to a surface of the intermediate anchor member such that the seal has an end extending outwardly therefrom; (3) attaching a rigid ring member within the end of the seal so as to expand a diameter of the end of the seal; (4) sliding the anchor member and the seal and the ring member along a tendon until the anchor member is in a desired position; and (5) removing the ring member from the end of the seal such that the end of the seal compressively engages the tendon in liquid-tight relationship therewith. The method of the present invention further includes the step of stripping a sheathing from the tendon so as to form a sheathed portion and an unsheathed portion of the tendon. The seal will compressively engage the sheathed portion of the tendon.

The method of the present invention also includes the steps of affixing the anchor member to a supporting structure, solidifying concrete within the supporting structure, and then tensioning the tendon from an end of the anchor member opposite the seal. The anchor member is encapsulated with a polymeric material so as to form a tubular extension extending outwardly therefrom. The seal is affixed to an exterior surface of this tubular extension. In particular, the tubular extension has a slot formed therein. The seal has an inwardly extending protrusion which engages the slot. The interior passageway of the anchor member and the ring member have an inner diameter greater than the diameter of the tendon. The ring member is formed with a forward end slidably received within the end of the seal and a rearward end having a diameter greater than the forward end.

DETAILED DESCRIPTION OF THE INVENTION

Figure 1:
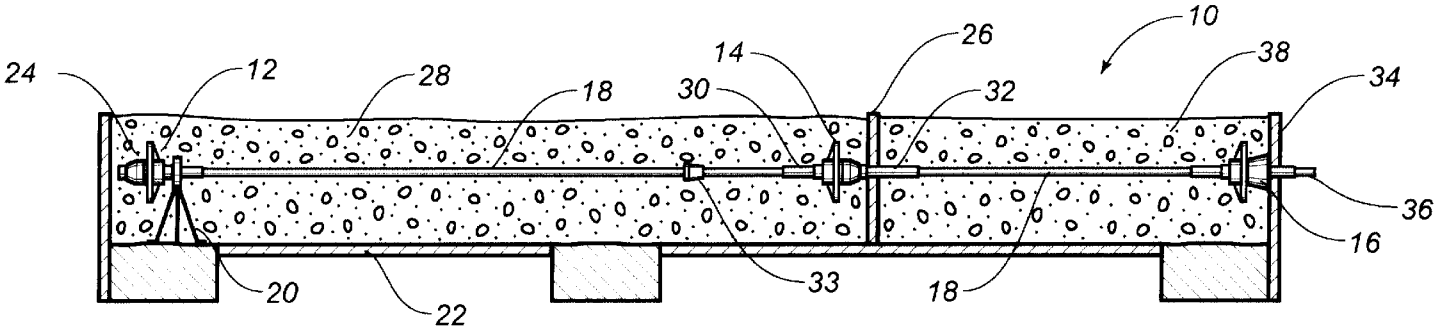
FIG. 1 is a side elevational view of a post-tensioning system employing the intermediate anchorage of the present invention.

In FIG. 1, there is shown the post-tensioning system in accordance with the teachings of the present invention. The post-tensioning system 10 includes a dead end anchor 12, an intermediate anchorage 14 and a live end anchor 16. A tendon 18 extends from the dead end anchor 12 through the intermediate anchorage 14 and into the live end anchor 16. The dead end anchor 12 is supported on a chair 20 above a slab 22 for a desired distance. The end 24 of the tendon is fixed into the dead end anchor 12. The tendon 18 extends from the dead end anchor 12 through the intermediate anchorage 14. The intermediate anchorage 14 is mounted on a frame 26 so as to support the intermediate anchorage 14 a desired distance above the floor or slab 22.

The tendon 18 is initially tensioned in the area between the intermediate anchor 14 and the dead end anchor 12. Suitable wedges are applied into the interior passageway of the intermediate anchor 14 so as to retain the tendon 18 in its stressed condition. A sealing member 30 is affixed to an end of the anchor 14 on an opposite side of the anchor 14 from the frame 26. Additionally, another tubular corrosion protection member 32 is affixed to the anchor 14 on an opposite side of the frame 26. The tubular corrosion protection member 32 extends over the exposed unsheathed portion of the tendon 18 which extends outwardly into the area between the intermediate anchorage 14 and the live end anchorage 16.

The live end anchor 16 is mounted on another frame 34 so as to support the live end anchor 16 a desired distance above the floor or slab 22. The end 36 of the tendon 18 will extend outwardly on an opposite side of the frame 34. The end 36 of the tendon 18 can be stressed so as to tension the tendon 18 in the area between the intermediate anchorage 14 and the live end anchor 16. In normal practice, this will cause the exposed portion of the tendon 18 in the area of the intermediate anchorage 14 to extend further outwardly of the intermediate anchorage 14. As such, the tubular corrosion protection member 32 should have a sufficient length so as to accommodate the tensioning of the tendon 18.

Importantly, in FIG. 1, in order to install the intermediate anchorage 14, it will be initially necessary to slide the intermediate anchorage 14 from the live end of the tendon therealong until it reaches its desired position within the supporting structure. To facilitate this installation, a rigid ring member 33, having a diameter greater than that of the tendon 18, is installed within the sealing member 30 prior to sliding along the tendon 18. As will be described hereinafter, the ring member 33 will allow the intermediate anchorage 14, and the sealing member 30, to slide freely along the tendon 18 to its desired position. The ring member 33 can then be detached from the sealing member 30 so as to allow the sealing member 30 to reside in compressive liquid-tight contact with the exterior surface of the tendon 18. The ring member 33 can then remain on the tendon 18 or be removed.

Figure 2:
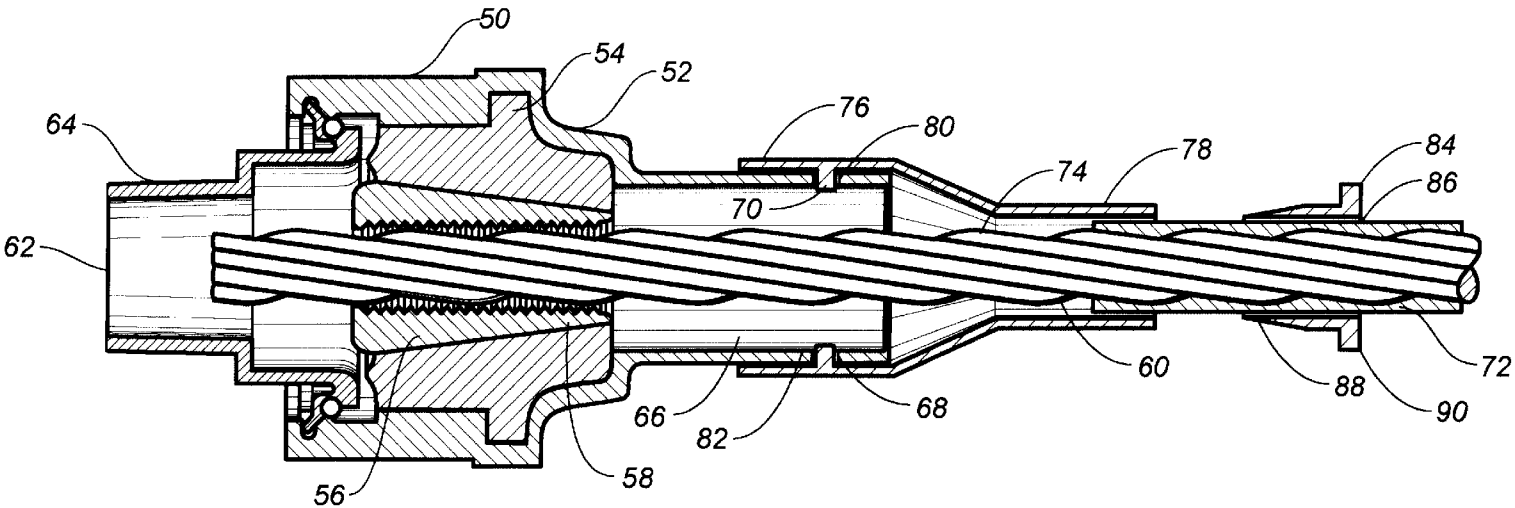
FIG. 2 is a cross-sectional view showing the intermediate anchorage system of the present invention.

FIG. 2 illustrates the arrangement of the intermediate anchorage system of the present invention. Initially, it can be seen that the anchor member 50 has an encapsulation 52 extending over a steel anchor 54. Wedges 56 are installed within the interior passageway 58 of the anchor 54 so as to affix the tendon 60 within the anchor member 50. The tendon 60 can extend outwardly from the anchor member 50 through an opening 62 formed in a cap member 64. The cap member 64 is positioned within the encapsulation 52 of the anchor member 50 in liquid-tight relationship therewith.

Importantly, it can be seen that the anchor member 50 has a tubular extension 66 integral with the encapsulation 52 and extending outwardly from an end of the anchor member 50. Slots 68 and 70 are formed in the tubular extension 66.

In FIG. 2, it can be seen that the tendon 60 has a sheathed portion 72 and an unsheathed portion 74. The wedges 56 will engage the unsheathed portion 74 of the tendon 60. So as to effect the sealing of the unsheathed portion 74 of the tendon 60, an elastomeric seal 76 is affixed over the exterior surface of the tubular extension 66. The elastomeric seal 76 will extend outwardly beyond the end of the tubular extension 66 and reduce in diameter so as to compressively engage the sheathed portion 72 of the tendon 60 at area 78. A suitable grout material can be used so as to fill the voids within the interior of the elastomeric seal 76 around the unsheathed portion 74 of the tendon 60. So as to establish a positive connection between the elastomeric seal 76 and the tubular extension 66, inwardly extending protrusions 80 and 82 are formed on the elastomeric seal 76 so as to engage with the slots 70 and 68, respectively, in the tubular extension 66. The engagement between the protrusions and the slots causes the elastic seal to be retained in the tubular extension when the ring member 84 is removed.

The rigid ring member 84 is illustrated as extending around the sheathed portion 72 of the tendon 60. The ring member 84 will have an interior passageway 86 of a greater diameter than that of the diameter of the sheathed portion 72 of tendon 60. The ring member 84 also has a tapered forward edge 88 and an outwardly radially extending shoulder 90. When applied over the sheathed portion 72, the ring member 84 can freely slide back and forth along the length of the tendon 60.

Figure 3:
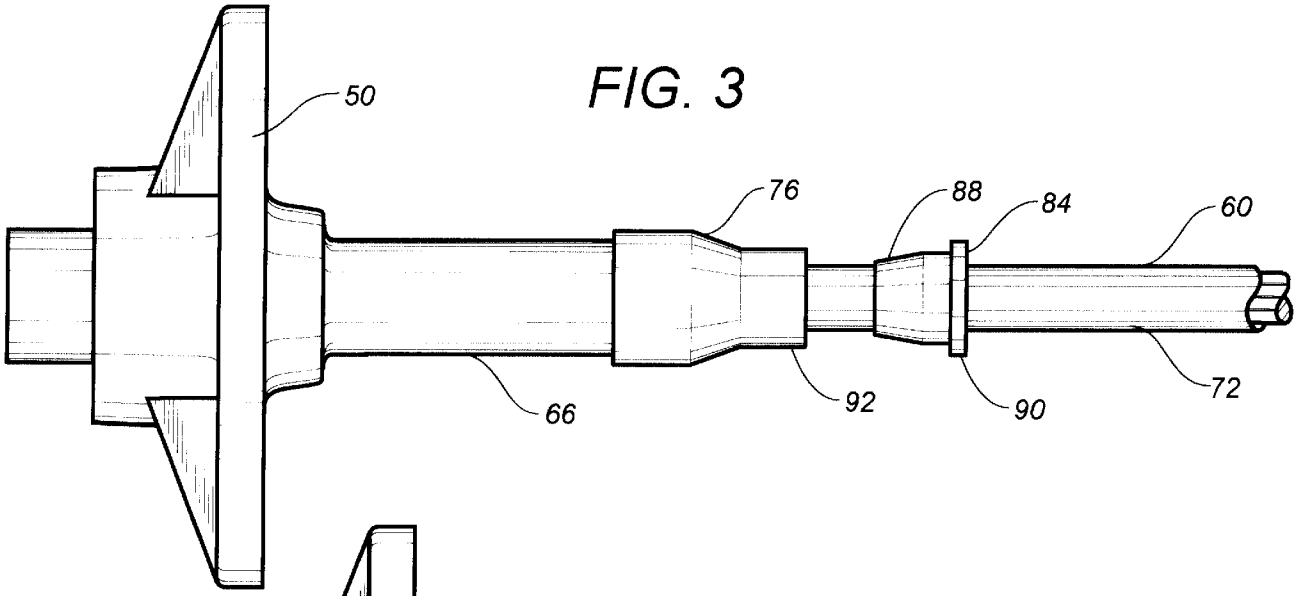
FIG. 3 is a plan view showing the intermediate anchorage system of the present invention with the ring member detached from the elastomeric seal.

FIG. 3 further shows the arrangement of the intermediate anchorage system shown in FIG. 2. As can be seen, the anchor member 50 has the tubular extension 66 extending outwardly therefrom. The elastomeric seal 76 compressively engages the exterior surface of the tubular extension 66. The sheathed portion 72 of tendon 60 will extend through the elastomeric seal 76 and through the tubular extension 66. The ring member 84 is illustrated as positioned adjacent to the end 92 of the elastomeric seal 76.

Figure 4:
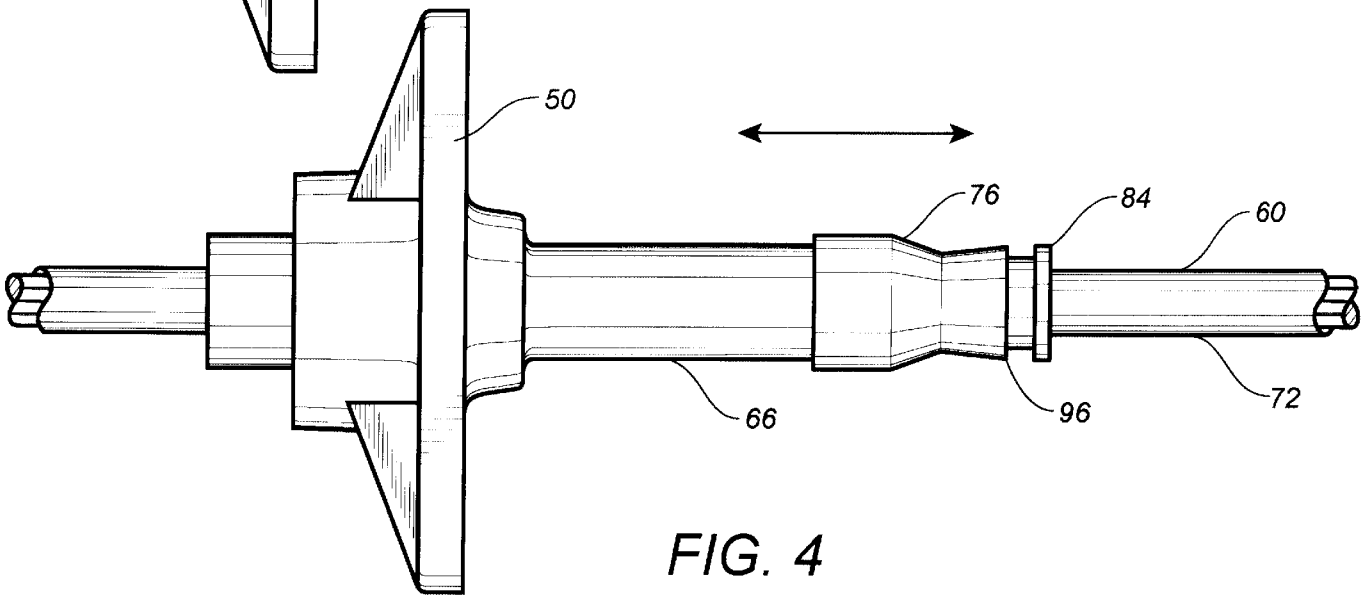
FIG. 4 is a plan view of the intermediate anchorage system of the present invention with a ring member engaged with the elastomeric seal.

FIG. 4 shows the operation of the present invention. In FIG. 4, the elastomeric seal 76 is shown with its end 96 positioned over and around the tapered portion 88 of the ring member 84. Since the end 96 of the elastomeric seal 76 is suitably elastic, the end 96 can easily fit over the tapered portion 88 of the ring member 84. This will expand the inner diameter of the elastomeric seal 76 to a diameter greater than that of the outer diameter of the sheathed portion 72 of the tendon 60. As shown by the arrows in FIG. 4, the anchor 50, the elastomeric seal 76 and the ring member 84 can freely slide back and forth along the tendon 60 by virtue of the action of the ring member 84. The present invention avoids the difficulty of sliding the end 96 of the elastomeric seal 76 along the extended length of the tendon 60. The ring member 84 will temporarily expand the opening at the end 96 and expand the interior passageway of the elastomeric seal 76 to a diameter which facilitates the ability to slide the elastomeric seal 76 along the tendon 60. Since the interior passageway of the anchor member 50 and the interior of the tubular extension 76 have a greater diameter than that of the sheathed portion 72 of the tendon 60, the anchor member 50, and the elastomeric seal 76 will be able to slide freely back and forth. When the anchor member 50 reaches its desired position for installation as an intermediate anchorage, the ring member 84 can be pulled away from the end 96 of the elastomeric seal 76 so as to cause the opening at the end 96 to reduce in diameter to compressively engage the outer diameter of the sheathed portion 72 of the tendon 60. As such, a liquid-tight seal is established in a quick and easy manner. The ring member can then be detached from the tendon 60 or can be remain on the tendon during the pouring of concrete thereover.

Figure 5:
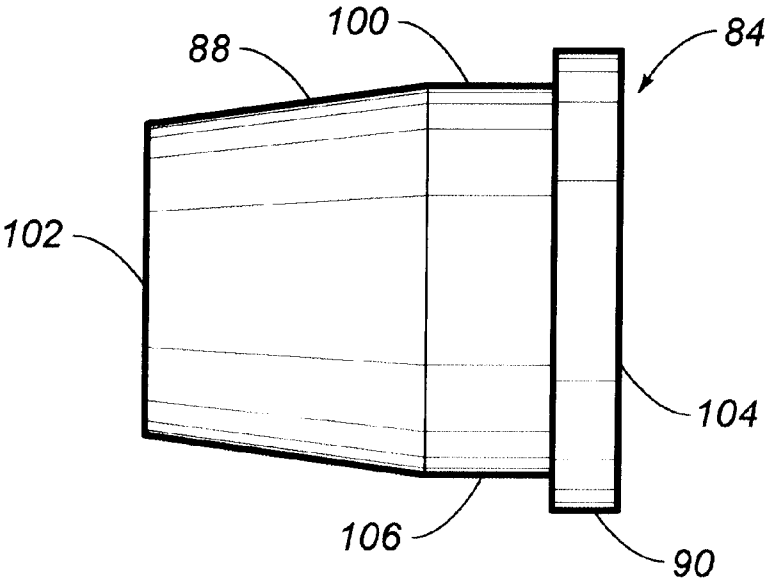
FIG. 5 is a side elevational view of the ring member of the present invention.

FIG. 5 shows an isolated view of the ring member 84. In FIG. 5, the ring member 84 has a body portion 100 having a tapered forward edge extending from the end 102 toward the end 104. The outwardly radially extending shoulder 90 is formed adjacent to the end 104. A constant diameter section 106 is formed between the tapered portion 88 and the shoulder 90. The tapered surface 88 facilitates the ability to install and remove the ring member 84 from the interior of the elastomeric seal 76.

Figure 6:
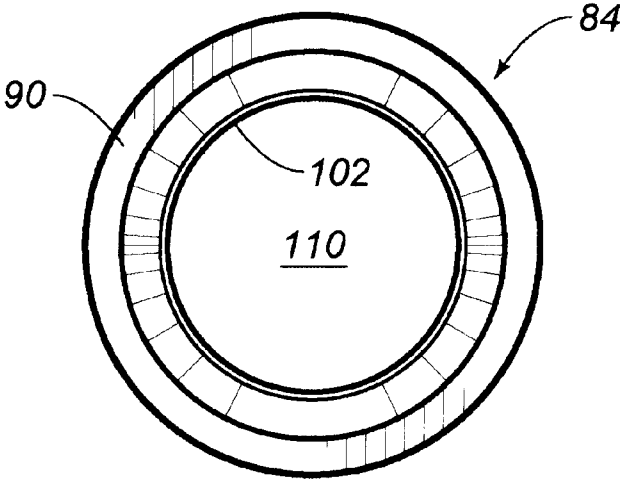
FIG. 6 is an end view of the ring member as used in the present invention.

FIG. 6 shows an end view of the ring member 84. As can be seen, the ring member has an interior passageway 110 having an inner diameter greater than that of the diameter of the sheathed portion 72 of the tendon 60. The end 102 will extend inwardly from the larger diameter shoulder 90.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An intermediate anchorage for a post-tension system comprising:

an anchor member having an interior passageway;

a tendon extending through said interior passageway of said anchor member;

an elastomeric seal having one end affixed to said anchor member and extending therefrom; and a rigid ring member detachably received within an opposite end of said seal, said ring member having an inner diameter greater than an outer diameter of said tendon, said opposite end of said seal having an elasticity such that said opposite end of said seal has a diameter matching said outer diameter of said tendon when said ring member is detached from said seal.

2. The system of claim 1, said anchor member having a tubular extension extending outwardly from an end thereof, said seal being affixed to an exterior of said tubular extension, said tubular extension having an inner diameter greater than a diameter of said tendon.

3. The system of claim 2, said tubular extension having a slot formed therein, said seal having a protrusion extending inwardly therefrom, said protrusion of said seal engaged with said slot of said tubular extension.

4. The system of claim 1, said opposite end of said seal being in liquid-tight compressive contact with an exterior surface of said tendon when said ring member is detached from said seal.

5. The system of claim 4, said tendon having a sheathed portion and an unsheathed portion, said seal being in compressive liquid-tight contact with said sheathed portion of said tendon when said ring member is detached therefrom.

6. The system of claim 5, said seal extending over and around said unsheathed portion of said tendon, said unsheathed portion of said tendon being affixed within said interior passageway of said anchor member.

7. The system of claim 1, said ring member having a body portion with a shoulder extending radially outwardly therefrom at an end of said ring member opposite said seal.

8. The system of claim 7, said body having a tapered end opposite said shoulder, said seal being received around said tapered end.

9. The system of claim 1, said anchor member being encapsulated with a polymeric material, said anchor member having a tubular extension formed of said polymeric material and extending outwardly therefrom, said seal being elastically engaged over an outer surface of said tubular extension.

10. A method of forming an intermediate anchorage in a post-tension system comprising:

forming an intermediate anchor member having an interior passageway;

affixing an elastomeric seal to a surface of said intermediate anchor such that said seal has an end extending outwardly therefrom;

attaching a ring member within said end of said seal so as to expand a diameter of said end of said seal;

sliding said anchor member and said seal and said ring member along a tendon until said anchor member is in a desired position; and removing said ring member from said end of said seal such that said end of said seal compressively engages said tendon in liquid-tight relationship therewith.

11. The method of claim 10, further comprising:

stripping a sheathing from said tendon so as to form a sheathed portion and an unsheathed portion of said tendon, said seal compressively engaging said sheathed portion of said tendon.

12. The method of claim 10, further comprising:

affixing said anchor member to a supporting structure;

solidifying concrete within said supporting structure; and tensioning said tendon from an end of said anchor member opposite said seal.

13. The method of claim 10, said step of forming an anchor member comprising:

encapsulating an anchor with a polymeric material so as to form a tubular extension extending outwardly therefrom, said seal being affixed to an exterior surface of said tubular extension.

14. The method of claim 13, said tubular extension having a slot formed therein, said seal having an inwardly extending protrusion engaging said slot.

15. The method of claim 10, said interior passageway of said anchor member and said ring member having an inner diameter greater than a diameter of said tendon.

16. The method of claim 10, further comprising:

forming a ring member having a forward end slidably received within said end of said seal and a rearward end having a diameter greater than said forward end.

17. A sealing apparatus for use with an anchor of a post-tension system comprising:

an elastomeric tubular seal having a first end and a second end, said first end being secured to an exterior surface of said anchor;

a rigid ring member detachably received within said second end of said tubular seal; and a tendon having a sheathed portion and an unsheathed portion, said second end of said tubular seal being compressively engaged in liquid-tight relationship with said sheathed portion when said ring member is removed from said second end, said ring member having an inner diameter greater than an outer diameter of said sheathed portion.

* * * * *